US006333969B1

(12) United States Patent
Kujirai

(10) Patent No.: US 6,333,969 B1
(45) Date of Patent: Dec. 25, 2001

(54) X-RAY TUBE

(75) Inventor: Masaji Kujirai, Tochigi-ken (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/423,615

(22) PCT Filed: Mar. 15, 1999

(86) PCT No.: PCT/JP99/01250

§ 371 Date: Dec. 30, 1999

§ 102(e) Date: Dec. 30, 1999

(87) PCT Pub. No.: WO99/48128

PCT Pub. Date: Sep. 23, 1999

(30) Foreign Application Priority Data

Mar. 16, 1998 (JP) ..... 10-065739

(51) Int. Cl.[7] ..... H01J 35/06

(52) U.S. Cl. ..... 378/138; 378/134; 378/136; 313/421

(58) Field of Search ..... 378/121, 134, 378/136, 137, 138; 313/421, 346 R

(56) References Cited

U.S. PATENT DOCUMENTS 4,868,842 * 9/1989 Dowd ..... 378/138
4,894,853 * 1/1990 Dowd ..... 378/138
5,884,963 * 12/1998 Koller et al. ..... 378/138

FOREIGN PATENT DOCUMENTS 2-144835 6/1990 (JP) .
5-121020 5/1993 (JP) .

* cited by examiner

*Primary Examiner*—Drew Dunn
(74) *Attorney, Agent, or Firm*—Oblon, Spivak, McClelland, Maier & Neustadt, P.C.

(57) ABSTRACT

An X-ray tube comprising an anode having a target surface radiating X-rays from a position of an X-ray focal spot by impingement of an electron beam, a focusing electrode and cathodes. The focusing electrode has a bottom portion positioned facing the target surface of the anode and most remote from the X-ray focal spot, at least one inclined wall surface obliquely ascending from the bottom portion in the direction of the anode, and substantially rectangular focusing recesses formed at the inclined wall surface. Each of the cathodes emits electron beams, positioned respectively in the focusing recesses of the focusing electrode. The focusing recess has first and second corners which curve from at least one end wall facing the end of the cathode to two side walls along the direction of the longer side of the cathode, and the first corner located remote from the bottom portion is gentler than the second corner located adjacent to the bottom portion with reference to condition of curving.

24 Claims, 12 Drawing Sheets

X-RAY TUBE

BACKGROUND OF THE INVENTION

This invention relates to an X-ray tube with reduced distortion of a configuration of X-ray focal spot.

DISCUSSION OF THE BACKGROUND

An X-ray tube is an electron tube in which X-rays are generated out of a target surface when thermal electrons generated out of a cathode filament impinge on the target surface of an anode, and is used, for example, for radiography of an object.

To take radiographs of an object, fluoroscopy in which the object is observed while being exposed by X-rays, and ordinary radiography in which X-ray images of the object are printed on such as photographic films, are in use. The fluoroscopy is done under a small dose of X-rays, while the ordinary radiography is done under a large dose of X-rays.

Usually an X-ray tube having plural focal spots is used when switching of the dose of X-rays to take radiographs of the object is required. For example, there is a method where plural kinds of focal spots whose sizes are different from each other, such as large focal spot and small focal spot, can be so formed that the small focal spot is used for fluoroscopy and large focal spot is used for ordinary radiography.

In a conventional X-ray tube, the case in which large and small X-ray focal spots are prepared, will be explained referring to FIG. 15. In the tube, there are cathode body 50 emitting thermal electrons, and disc shaped rotating anode 52 placed facing the cathode body. Upper and lower surfaces of rotating anode 52 in the figure are flat, and the target surface is inclined to the surface planes thereof.

Inside rectangular shaped focusing slots 54*a,* 54*b* in focusing electrode 51 forming cathode body 50, there are two cathodes for emitting thermal electrons, for instance, coil shaped direct heated filaments 53*a,* 53*b*. One of the two filaments 53*a,* for example is for large focal spot, and the other filament 53*b* is for small focal spot. Focusing recesses 54*a,* 54*b* shape an electrostatic field to converge electrons emitted out of filaments 53*a,* 53*b* onto the surface of the anode target and to confine within the focal spot whose size and configuration are predetermined. The electron beam impinging area is, of course, the X-ray focal spot.

For an X-ray tube with two focal spots, it is necessary that a discrepancy between position of taking radiographs of an object using large focal spot and the object using small focal spot does not occur. For this purpose, two focal spots of electrons emitted out of filaments 53*a,* 53*b* are placed on substantially the same position of the target surface of anode 52.

For the reason, bottom portion M is formed, making the central portion of focusing electrode 51 recessed. At slopes 51*a,* 51*b* located on the opposite side of bottom portion M to each other to shape a V-character, focusing recesses 54*a,* 54*b* are formed respectively, the openings of focusing recesses 54*a,* 54*b* facing toward inside. In this case, the opening end of one of focusing recesses 54*a* is inclined at predetermined angle $\alpha$ to the straight line connecting the bottom portion with the focal spot, i.e., to the surface H normal to a center axis C, and the opening end of the other of focusing recesses 54*b* is inclined at predetermined angle $\beta$ in the same manner. Here, Lw denotes the width of the opening end along the slope of focusing recess 54*a* and Sw denotes the width of the opening end along the slope of focusing recess 54*b*.

Next, FIG. 15*c* shows the structure of filaments 53*a,* 53*b* and focusing recesses 54*a,* 54*b* seen from anode 52. This figure is the plan view of each slope seen in directions 15*c,* 15*d* perpendicular thereto.

The overall contour of the focusing electrode is making substantially cylindrical configuration. Two filaments 54*a,* 54*b* are located parallel to each other in the same direction along linear bottom portion M. Thus focusing recesses 54*a,* 54*b* are substantially rectangular in the direction of the extension of bottom portion M, in compliance with filaments 53*a,* 53*b* accommodated therein. To manufacture X-ray tubes, two focusing recesses 54*a,* 54*b* are prepared by recess machining in the same process. Four corners L1 to L4 of the walls forming focusing recess 54*a* and four corners S1 to S4 of the walls forming focusing recess 54*b* are round surfaces having the same curvature radius. In conventional X-ray tubes, curvature radii of corners L1 to L4, and S1 to S4 are generally not greater than 0.3 time of the recess widths Lw, Sw along slopes 51*a,* 51*b* of the openings end of focusing recesses 54*a,* 54*b*.

In above mentioned structure, thermal electrons emitted from filaments 53*a,* 53*b* are focused by the electrostatic field inside focusing recesses 54*a,* 54*b* and form focal spots 57*a,* 57*b* on the target surface of anode 52, after following trajectories 56*a,* 56*b* as shown in FIG. 15*a*. In this case, the configurations of the focal spots of thermal electrons are shown in FIG. 15*b*. Marks 57*a* and 57*b* denote large focal spot and small focal spot respectively, and bow shaped distortions take place along the direction in which filaments 53*a,* 53*b* are laid. Distortions of the focal spot results in expansion of effective size thereof, by the area swelling outside as noted by A1, A2.

In conventional X-ray tubes, distortion of the configuration of the focal spot formed on the target surface of the anode results in expansion of the size of the focal spot, and as a result, in deterioration of quality of radiographs. The distortion of the configuration of focal spot is due to losing the uniformity of running trajectories of thermal electrons, caused by the distortion of focusing field for electron beams. The reason of aforementioned distortion of focusing field is that the surface of the focusing electrode facing the disc shaped rotating anode inclines in V shape, and the focusing recesses formed in the focusing electrodes are rectangular and have some discrepancy of the position to each other, even though the focusing electrode is cylindrical.

SUMMARY OF THE INVENTION

An object of the present invention is to overcome the above mentioned disadvantages and to provide an X-ray tube having X-ray focal spots with less distortion.

BRIEF DESCRIPTION OF THE DRAWINGS

FIG. 2 shows an embodiment of the present invention, where

FIG. 11 shows another embodiment of the present invention, where

FIG. 12 shows another embodiment of the present invention, where

FIG. 13*a* illustrates the configuration with conventional technology, FIG. 13*b* illustrates the configuration when curvature radii of four corners of the focusing recesses are different from each other, and FIG. 13*c* illustrates the configuration when curvature radii of four corners of the focusing recesses are different from each other and an auxiliary recess is provided;

FIG. 15 shows conventional technology, where

DETAILED DESCRIPTION OF THE PREFERRED EMBODIMENTS

Figure 1:
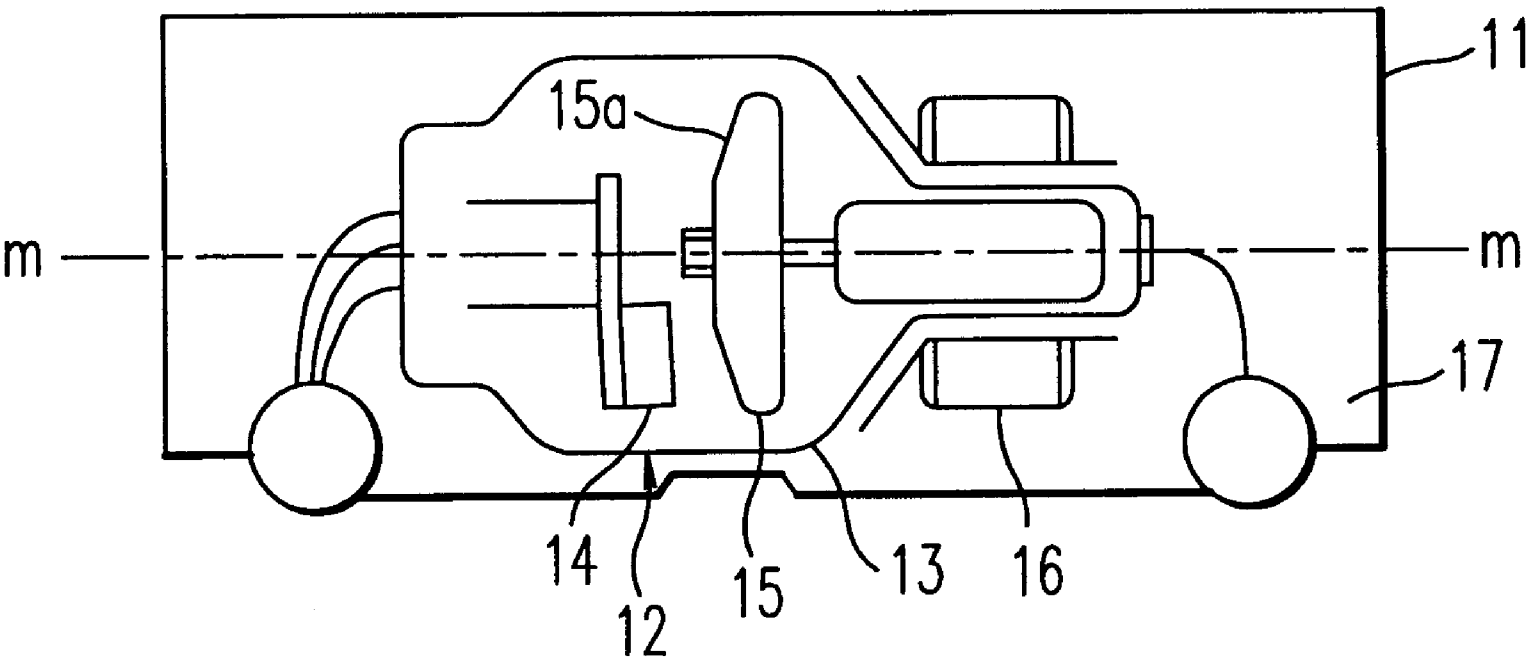
FIG. 1 is a schematic view showing an embodiment of the present invention.

An embodiment of the present invention will be described with reference to the schematic view shown in FIG. 1. Reference number 11 denotes a housing constituting an X-ray tube device, and X-ray tube 12 is mounted in housing 11. The X-ray tube is constituted of evacuated envelope 13, cathode body 14 and rotating anode 15 provided with a cone shaped target surface of refractory metal such as tungsten within envelope 13. Stator 16 is attached outside envelope 13 to rotate rotating anode 15. The inside of housing 11 is filled up with insulating oil 17. Line m-m means the axis of the X-ray tube, i.e. the rotating axis of the anode.

Referring to FIG. 2, the structure of cathode body 14 and rotating anode 15 constituting X-ray tube 12 will be explained, as an example, about the case in which two (large and small) focal spots are formed.

Cathode body 14 faces target surface 15*a* of rotating anode 15. Target surface 15*a* is inclined to the tube axis at a predetermined angle.

Focusing electrode 18 which is the principal part of cathode body 14 is made of a metal body of substantially cylindrical configuration. The surface facing rotating anode 15 is cut in V-shape, and two slopes 18*a,* 18*b* which intersect each other at a predetermined angle obliquely ascending toward rotating anode 15 are formed with intervention of the boundary portion between the two slopes, i.e., bottom portion M mentioned later. Outside the slopes, narrow flat area 18*c* is formed. At both slopes 18*a,* 18*b,* two (large and small) rectangular focusing recesses 22*a,* 22*b* are prepared. Inside both focusing recesses 22*a,* 22*b,* two (large and small) coil shaped direct heated filaments 21*a,* 21*b* in parallel are accommodated. For example, filament 21*a* is for large focal spot and filament 21*b* is for small focal spot. Focusing recesses 22*a,* 22*b* shape an electrostatic field by which electron beams emitted from filaments 21*a,* 21*b* are converged on a focal spot of a predetermined size.

For X-ray tubes with two focal spots, it is necessary that discrepancy between the position of taking radiographs of an object using large focal spot and the object using small focal spot does not occur. For the purpose, focal spots of electrons emitted from filaments 21*a,* 21*b* are to overlap at substantially the same position, namely at center line C on target surface 15*a* of anode 15 which is inclined to tube axis m.

The most deeply recessed part of focusing electrode 18, e.g., the most remote linear portion from the focal spot of target surface 15*a* is bottom portion M. Bottom portion M is, for instance, substantially parallel to target surface 15*a* just thereunder, and both sides thereof are slopes 18*a,* 18*b* intersecting each other at a predetermined angle. As a result, the openings of focusing recesses 22*a,* 22*b* face inside each other. One of the slopes 18*a* of focusing electrode 18 inclines at predetermined angle $\alpha$ to flat surface 18*c* i.e. a surface perpendicular to center line C, the other of the slopes 18*b* inclines at a predetermined angle, e.g., $\beta$ which is different from angle $\alpha$ of slope 18*a*. The recess width along the slope of the opening end of focusing recess 22*a* for large focal spot and the recess width of focusing recess 22*b* for small focal spot are represented by Lw and Sw respectively.

Figure 2A:
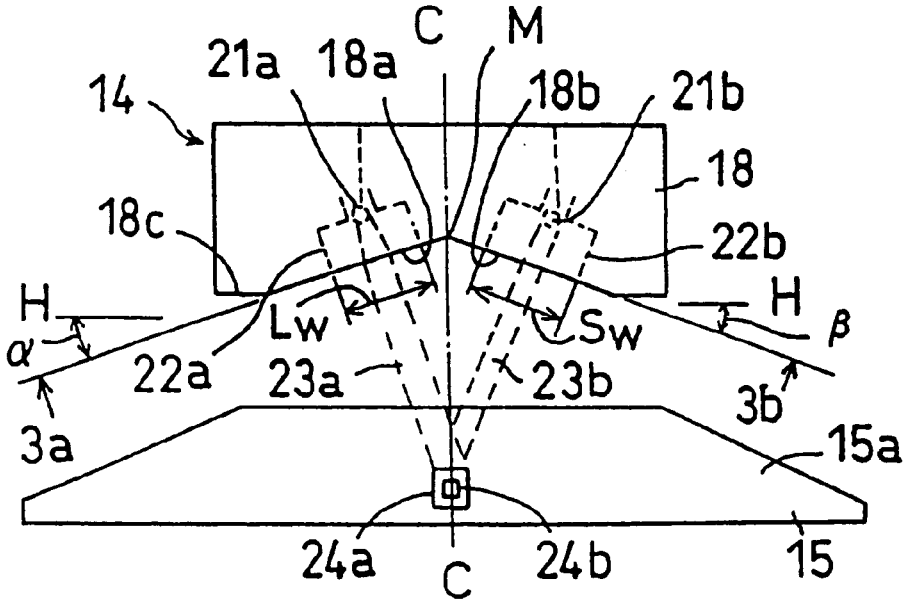
FIG. 2*a* is a schematic view showing the structure of cathode portion and anode portion.
Figure 2B:
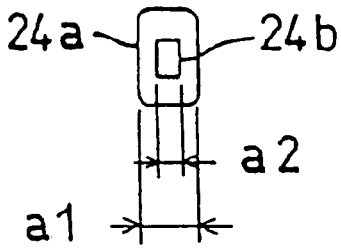
FIG. 2*b* is a plan view showing the configuration of focal spots.
Figure 3:
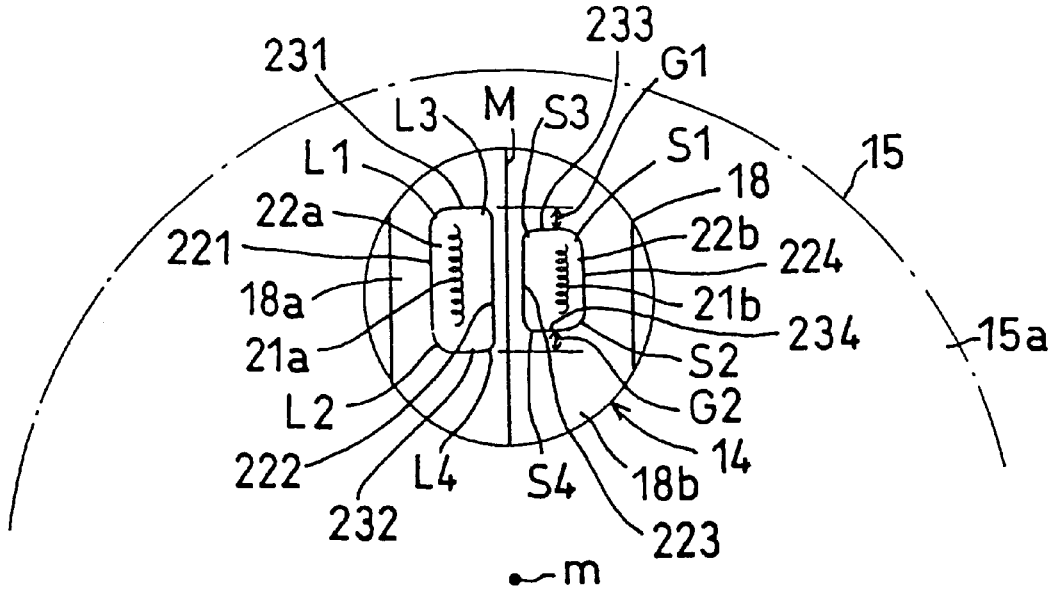
FIG. 3 is a schematic plan view showing another embodiment of the present invention to explain the structure of the cathode portion.
Figure 4:
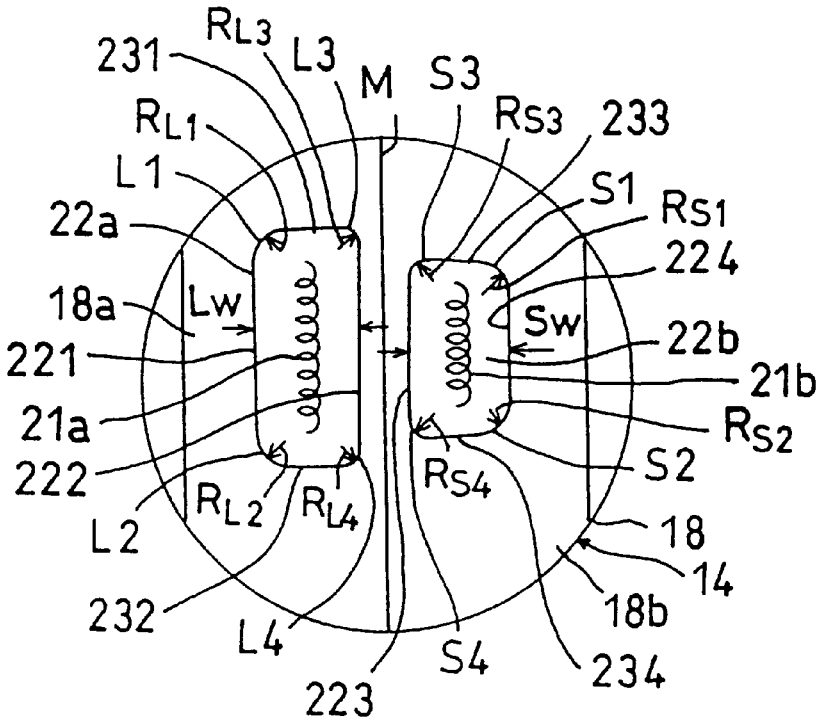
FIG. 4 is a plan view showing another embodiment of the present invention, magnifying the cathode portion.

Referring to FIGS. 3 and 4, structures of portions of filaments 21*a,* 21*b*, focusing recesses 22*a,* 22*b* etc. seen from anode 15 will be explained. These figures show only states of focusing recesses 22*a,* 22*b* and filaments 21*a,* 21*b* in FIG. 2 seen in the directions 3*a,* 3*b* perpendicular to slopes 18*a,* 18*b*. To show the relative relation to target surface 15*a* of rotating anode 15, the corresponding position of rotating anode 15 is denoted by a dash-dot line and the rotating axis thereof, namely the tube axis of X-ray tube 12 is denoted by mark m.

Overall configuration of the focusing electrode 18 is substantially cylindrical. Focusing recesses 22*a,* 22*b* and filaments 21*a,* 21*b* are located parallel to each other and formed long in one direction, i.e. the direction of the extension of bottom portion M. Focusing recesses 22*a,* 22*b* are so arranged that a pair of longer side walls thereof, i.e. side wall 221 and side wall 222, or side wall 223 and side wall 224 are parallel and adjacent to each other respectively. In this case, focusing recess 22*a* and focusing recess 22*b* are positioned in line symmetry with respect to the line passing through the central portions of the side walls, because the central portions of the side walls thereof are located on substantially the same line. Thus the deviation lengths G1, G2 between the shorter end walls of focusing recess 22*a* and that of the recess 22*b*, namely between end wall 231 and end wall 233, between end wall 232 and end wall 234 with reference to the direction of the extension of bottom portion M are substantially the same.

Here, referring to FIG. 4 showing an enlargement of cathode body 14, the structures of focusing recesses 22*a*, 22*b* will be described. One focusing recess 22*a* for large focal spot has four corners L1 to L4, and in the same way the other focusing recess 22*b* for small focal spot has four corners S1 to S4 too.

With regard to focusing recess 22*a* for large focal spot, curvature radii RL1, RL2 of corners L1, L2 lying remote from bottom portion M are greater than, for example, curvature radii RL3, RL4 of corners L3, L4 lying adjacent to bottom portion M, therefore curving degree of corners L1, L2 changes gently.

In the same way, with regard to focusing recess 22*b* for small focal spot, curvature radii RS1, RS2 of corners S1, S2 lying remote from bottom portion M are greater than, for example, curvature radii RS3, RS4 of corners S3, S4 lying adjacent to bottom portion M, therefore curving degree of corners S1, S2 changes gently.

Preferably the curvature radii of the corners remote from bottom portion M are not less than one third (⅓) of the width of the focusing recess. However it is practically preferable that the upper limit of these curvature radii be about four fifths (⅘) of the width of the focusing recess.

Therefore, with regard to focusing recess 22*a* for large focal spot, curvature radii RL1, RL2 of corners L1, L2 remote from bottom portion M are defined to not less than one third (⅓) of recess width Lw. Besides, curvature radii RL3, RL4 of corners L3, L4 adjacent to bottom portion M are defined to less than one third (⅓) of recess width Lw.

With regard to focusing recess 22*b* for small focus, curvature radii RL3, RL4 of corners L3, L4 remote from bottom portion M are set to not less than one third (⅓) of recess width Sw. Besides, curvature radii RS3, RS4 of corners S3, S4 adjacent to bottom portion M are set to less than one third (⅓) of recess width Sw.

Now, a specified example of dimension is as follows: In a rotating anode X-ray tube where effective sizes of X-ray focal spot, i.e., X-ray focus sizes seen in the direction of the center line of main utilization of emanated X-rays are designed to be 1.2 mm×1.2 mm for large focal spot, and 0.6 mm×0.6 mm for small focal spot, dimensions of each portion are set below.

Namely, length of focusing recess 22*a* for large focal spot is 18 mm, width Lw of the focusing recess is 7 mm, depth of the focusing recess is 3.5 mm, curvature radius RL1 is 3.5 mm, RL2 is 3 mm, RL3 is 1 mm, and RL4 is 1 mm. Also, length of focusing recess 22*a* for small focal spot is 13 mm, width Sw of the focusing recess is 6.5 mm, depth of the focusing recess is 4.0 mm, curvature radius RS1 is 3 mm, RS2 is 2.5 mm, RS3 is 1 mm, and RS4 is 1 mm. The angle at which slopes 18*a*, 18*b* intersect each other is 130°.

In the structure mentioned above, thermal electron beams emitted from filaments 21*a*, 21*b* are converged by an electrostatic field in focusing recesses 22*a*, 22*b* to form both focal spots 24*a*, 24*b* on center line C of target 15*a* of anode 15 after following trajectories 23*a*, 23*b*, then X-rays are radiated from the focus position as shown in FIG. 2*a*. In this case, as the configuration of the focal spot formed on target surface 15*a* is as shown in FIG. 2*b*, distortion in large focal spot 24*a* and small focal spot 24*b* hardly takes place. Thus effective dimensions of the targets are a1, a2, which are smaller than conventional case having some distortion. The configuration of focus in FIG. 2*b* represents the shape of the surface where electron beams collide, in the direction perpendicular to the slope of the anode target. Effective focal spots seen in the direction of utilization of radiated X-rays are substantially square as shown in FIG. 2*a*.

It is thought that this is due to the fact that the electric field in the vicinity of focusing recesses 22*a*, 22*b* particularly in the direction of the longer side of the rectangular recess becomes uniform, because the curvature radii of corners L1, L2 constituting focusing recess 22*a* and the curvature radii of corners S1, S2 constituting focusing recess 22*b* are greater than those of the rest of corners to make the curving degree of curved surfaces mentioned above change gently.

Figure 5:
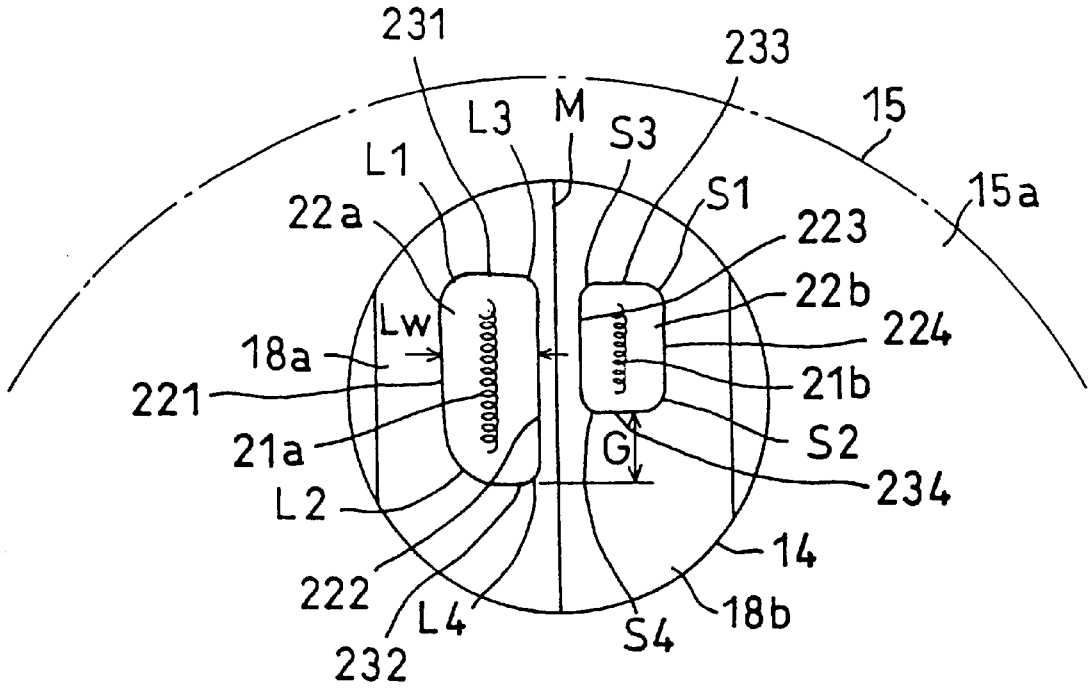
FIG. 5 is a plan view showing another embodiment of the present invention to explain the structure of the cathode portion.

Next, referring to FIG. 5, another embodiment of the present invention will be explained. In FIG. 5, portions corresponding to those in FIGS. 3 and 4 are denoted by the same marks as in these figures, and repeated explanations will be partially omitted.

In this embodiment, the shorter end wall 231 at the upper side of the figure, of focusing recess 22*a* for large focal spot and the shorter end wall 233 at the upper side of the figure, of focusing recess 22*b* for small focal spot are laid on substantially the same position in reference to the direction of the extension of bottom portion M. Thus, with respect to deviation G of position in the direction of the extension of bottom portion M, the deviation between the end wall of focusing recess 22*a* and that of focusing recess 22*b* at the lower side of the figure, i.e., the deviation between end wall 232 and end wall 234 is greater than the deviation between end wall 231 and end wall 233. In this case, the curvature radius of corner L2 of focusing recess 22*a* for large focal spot, which is at the side of deviation G and outside, is set to be the greatest of all corners. Then, curvature radii of corners L1, S1, S2 decrease in this order, and are all greater than the curvature radii of the remaining corners, i.e., the curvature radii of corners L3, L4, S3, S4 which are at the side walls adjacent to bottom portion M.

Preferably the curvature radius of corner L2 is not smaller than one third of the width of focusing recess 22*a* for large focal spot, namely the recess width Lw at the center in the direction of the longer side of the recess.

Figure 6:
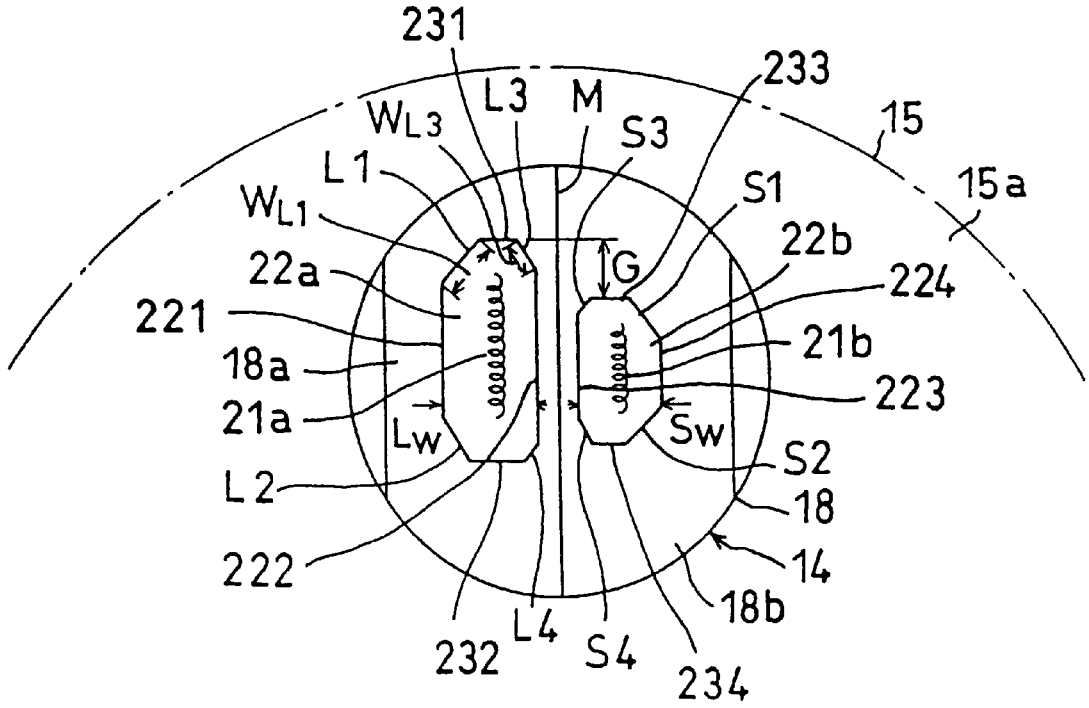
FIG. 6 is a plan view showing another embodiment of the present invention to explain the structure of the cathode portion.

Referring to FIG. 6, another embodiment of the present invention will be explained. In FIG. 6, portions corresponding to those in FIG. 3 through FIG. 5 are denoted by the same marks as in these figures, and repeated explanations will be partially omitted. In this embodiment, corners L1 to L4 and S1 to S4 of focusing recesses 22*a*, 22*b* respectively are formed as the plane wall surfaces, e.g., as the flat surfaces with predetermined width lengthened in the direction of depths of focusing recesses 22*a*, 22*b*. This embodiment has the same effects as those in the case of curved corner surfaces.

In this embodiment, the shorter end wall 232 at the lower side of the figure, of focusing recess 22*a* for large focal spot and the shorter end wall 234 at lower side of the figure, of focusing recess 22*b* for small focal spot are laid on substantially the same position in reference to the direction of the extension of bottom portion M. Thus, with respect to deviation G of position in the direction of the extension of bottom portion M, the deviation between the end wall of focusing recess 22*a* and that of focusing recess 22*b* at the upper side of the figure, i.e. the deviation between end wall 231 and end wall 233 is greater than the deviation between end wall 232 and end wall 234. In this case, the width of wall WL1 of corner L1 of focusing recess 22*a* for large focal spot, which is at the side of greater deviation G and outside, is set to be the widest of all corners. Then, widths of corners L2, L3, L4 decrease in this order. With reference to focusing recess 22*b* for small focal spot, the widths of the wall surfaces of corners S1, S2 are set to be wider in length by the same degree and the widths of the wall surfaces of corners S3, S4 are narrower than those of corners S1, S2.

Therefore, when the widths of the wall surfaces of corners L1 to L4 are WL1 to WL4 respectively, and the widths of the wall surfaces of corners S1 to S4 are WS1 to WS4 respectively, then

WL1>WL2>WL3>WL4,

WS1=WS2>WS3 or WS4.

Preferably, the widths of the wall surfaces of the corners of the focusing recesses remote from bottom portion M are not narrower than one third of the widths Lw, Sw of the focusing recesses respectively. The upper limit thereof is about four fifths of the widths of the recesses.

Figure 7:
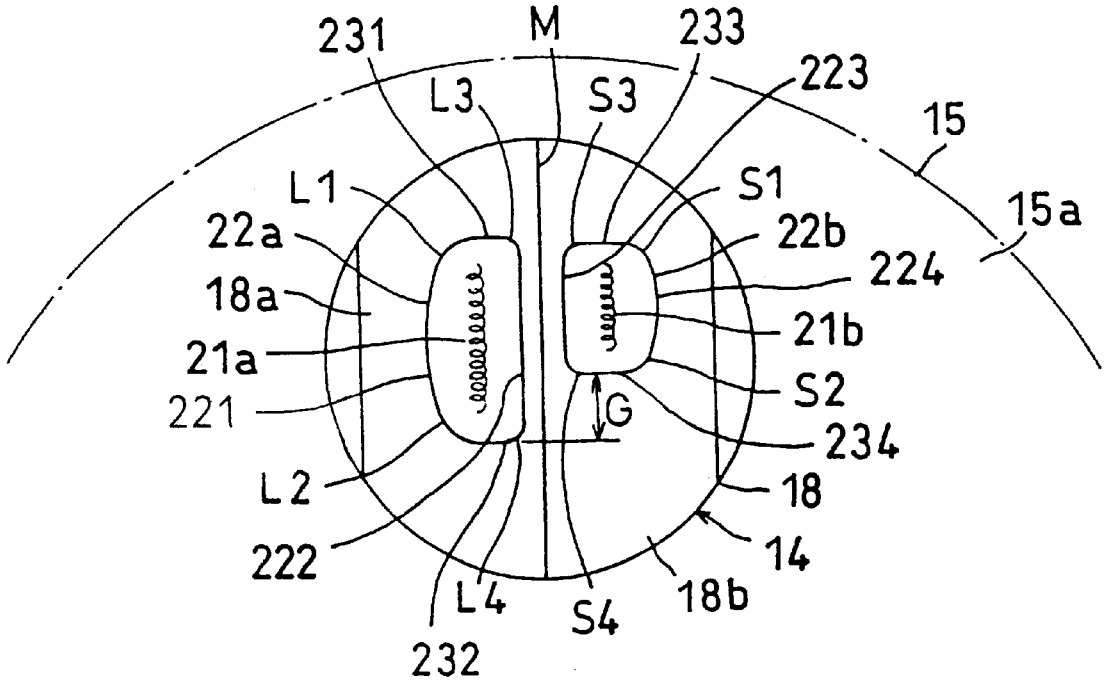
FIG. 7 is a plan view showing another embodiment of the present invention to explain the structure of the cathode portion.

Next, referring to FIG. 7, another embodiment of the present invention will be explained. In FIG. 7, portions corresponding to those in FIG. 3 through FIG. 6 are denoted by the same marks as in these figures, and repeated explanations will be partially omitted. In this embodiment, for example, side walls 221, 224 of focusing recesses 22*a*, 22*b* remote from bottom portion M are gently curved surfaces swelling outside throughout. Side walls 222, 223 adjacent to bottom portion M are substantially linear and parallel to each other. Besides, with reference to focusing recesses 22*a*, 22*b*, end walls 231, 233 at the upper side of the figure are laid on substantially the same position in reference to the direction of the extension of bottom portion M. Thus, with respect to deviation G of position in the direction of the extension of bottom portion M, the deviation between the end wall of focusing recess 22*a* and that of focusing recess 22*b* at the lower side of the figure, i.e., the deviation between end wall 232 and end wall 234 is greater than the deviation between end wall 231 and end wall 233.

In this case, the curvature radius of corner L2 of focusing recess 22*a* for large focal spot, which is at the side of greater deviation G, is set to be the greatest of all corners. Then, curvature radii of corners L1, S1, S2 decrease in this order, and are greater than the curvature radii of corners L3, L4, S3, S4 which are at the side walls adjacent to bottom portion M. Preferably, the curvature radii of the corners of the focusing recesses remote from bottom portion M are not smaller than one third of the widths of the corresponding focusing recesses.

Figure 8:
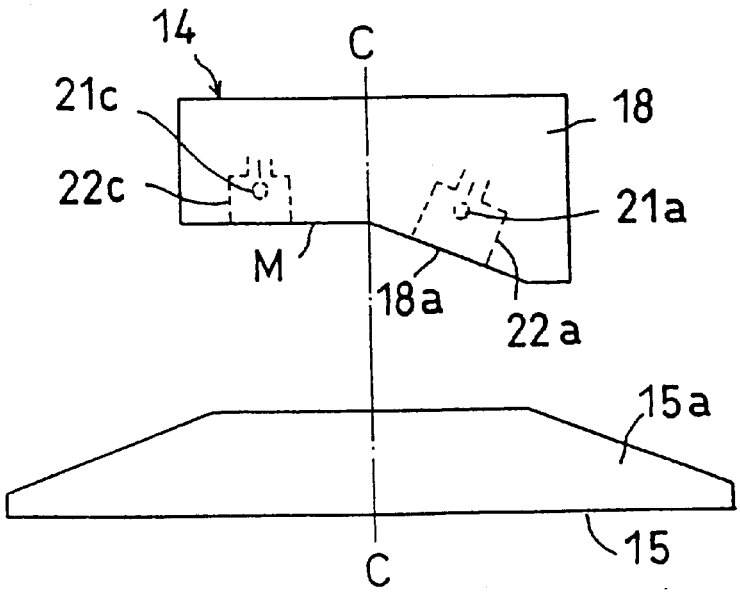
FIG. 8 is a schematic side view showing another embodiment of the present invention.

Next, referring to FIG. 8, another embodiment of the present invention will be explained. In the embodiments explained heretofore, focusing electrodes have V-shaped slopes. However in the embodiment shown in FIG. 8, bottom portion M is a plane surface which does not incline to the target surface of rotating anode 15, and slope 18*a* is formed only on one side of bottom portion M. At bottom portion M, filament 21*c* which emits electron beams for electron bombard heating used for heating the target surface, for example, at exhausting process for manufacturing, and focusing recess 22*c* for the electron beams are provided.

Focusing recess 22*a* and filament 21*a* for generating X-rays to take radiographs of an object are formed at slope 18*a*. In the structure like this, the same effect may be obtained, for example, by giving the aforementioned relations to focusing recess 22*a* provided at slope 18*a* and the curvature radius or the width of plane wall. Namely, the curvature radii of the corners remote from bottom portion M of the focusing recesses are set to be greater than the curvature radii of the corners adjacent to bottom portion M.

Figure 9:
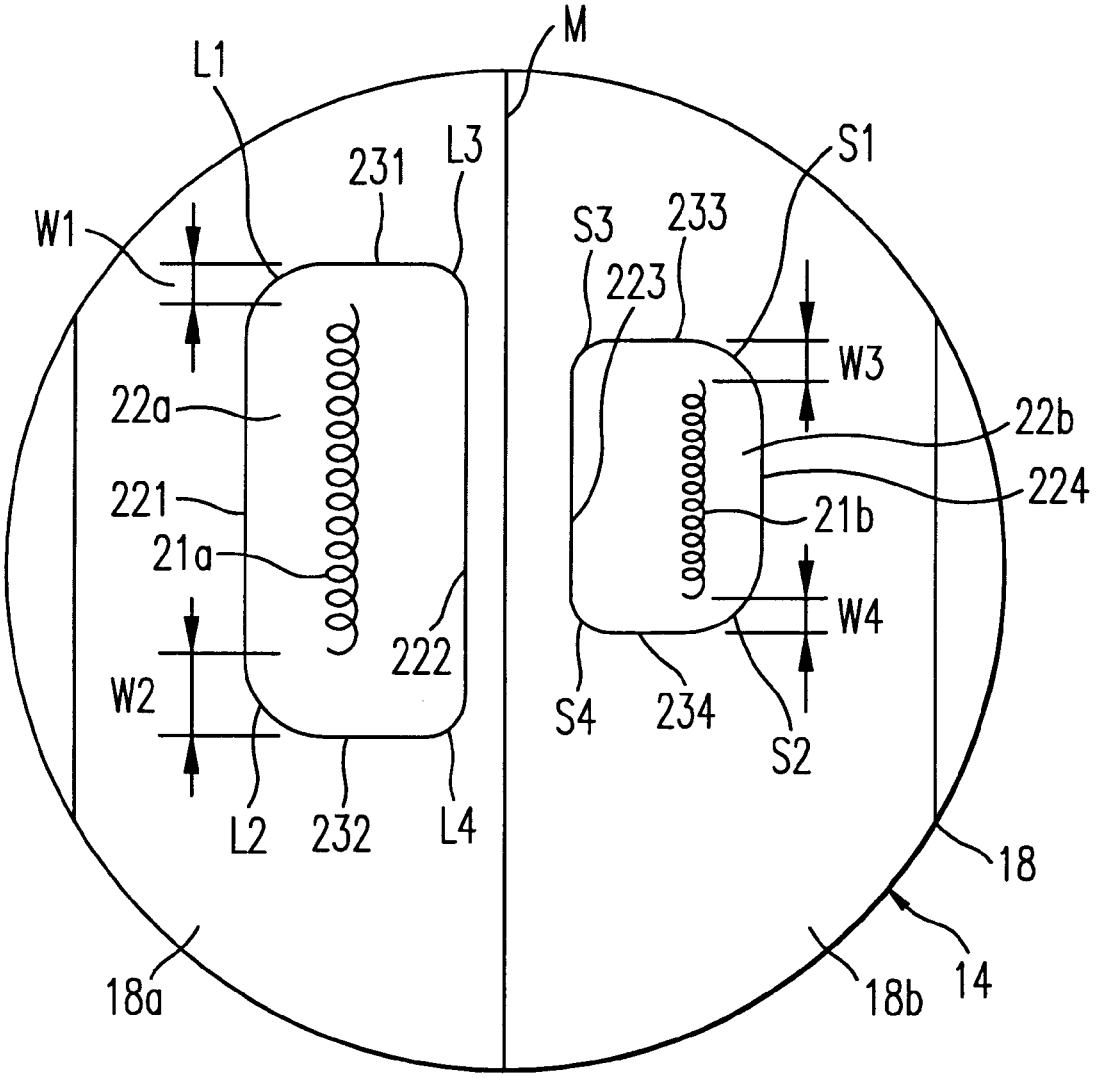
FIG. 9 is a plan view showing another embodiment of the present invention to explain the structure of the cathode portion.

Next, referring to FIG. 9, another embodiment of the present invention will be explained. In FIG. 9, portions corresponding to those in FIG. 3 through FIG. 7 are denoted by the same marks as in these figures, and repeated explanations will be partially omitted.

In the case of this embodiment, with reference to focusing recess 22*a* for large focal spot, the curvature radii of the corners L1, L2 remote from bottom portion M of the focusing recesses are set to be greater than the curvature radii of the corners L3, L4 adjacent to bottom portion M. Also, the curvature radius of corner L1 is set to be in the range from 1 to 3 times of space W1 between the end of filament 21*a* adjacent to corner L1 and end wall 231 of the recess facing this end of the filament 21*a*. Further, the curvature radius of corner L2 is set to be in the range from 1 to 3 times of space W2 between the end of filament 21*a* adjacent to corner L2 and end wall 232 of the recess facing this end of the filament 21*a*.

Besides, with reference to focusing recess 22*b* for small focal spot, the curvature radii of the corners S1, S2 remote from bottom portion M of the focusing recesses are set to be greater than the curvature radii of the corners S3, S4 adjacent to bottom portion M. Also, the curvature radius of corner S1 is set to be in the range from 1 to 3 times of space W3 between the end of filament 21*b* adjacent to corner S1 and end wall 233 of the recess facing this end of the filament 21*b*. Further, the curvature radius of corner S2 is set to be in the range from 1 to 3 times of space W4 between the end of filament 21*b* adjacent to corner S2 and end wall 234 of the recess facing this end of filament 21*b*.

Moreover, the curvature radius of corner L3 of focusing recess 22*a* is set to be in the range from 0.2 to less than 1 time of space W1 between the end of filament 21*a* adjacent to corner L2 and end wall 231 of the recess. And the curvature radius of corner L4 is set to be in the range from 0.2 to less than 1 time of space W2 between the end of filament 21*a* adjacent to corner L4 and end wall 232 of the recess.

In the same way, the curvature radius of corner S3 of focusing recess 22*b* is set to be in the range from 0.2 to less than 1 time of space W3 between the end of filament 21*b* adjacent to corner S3 and end wall 233 of the recess. And the curvature radius of corner S4 is set to be in the range from 0.2 to less than 1 time of space W4 between the end of filament 21*b* adjacent to corner S4 and end wall 234 of the recess.

Besides, in this embodiment, with reference to both focusing recess 22*a* for large focal spot and focusing recess 22*b* for small focal spot, the two corners remote from bottom portion M are set to be 1 to 3 times of the space between the end wall and the end of the filament. However only one of the above two corners may be set to be as mentioned above. Furthermore, only one of four corners of focusing recesses 22*a*, 22*b* remote from bottom portion M may be set to be as mentioned above.

Moreover, with reference to both focusing recess 22*a* and focusing recess 22*b*, the two corners adjacent to bottom portion M are set to be in the range from 0.2 to less than 1 time of the space between the end wall and the end of the filament. However only one of the above two corners may be set to be as mentioned above. Furthermore, only one of four corners of focusing recesses 22*a*, 22*b* adjacent to bottom portion M may be set to be as mentioned above.

Figure 10:
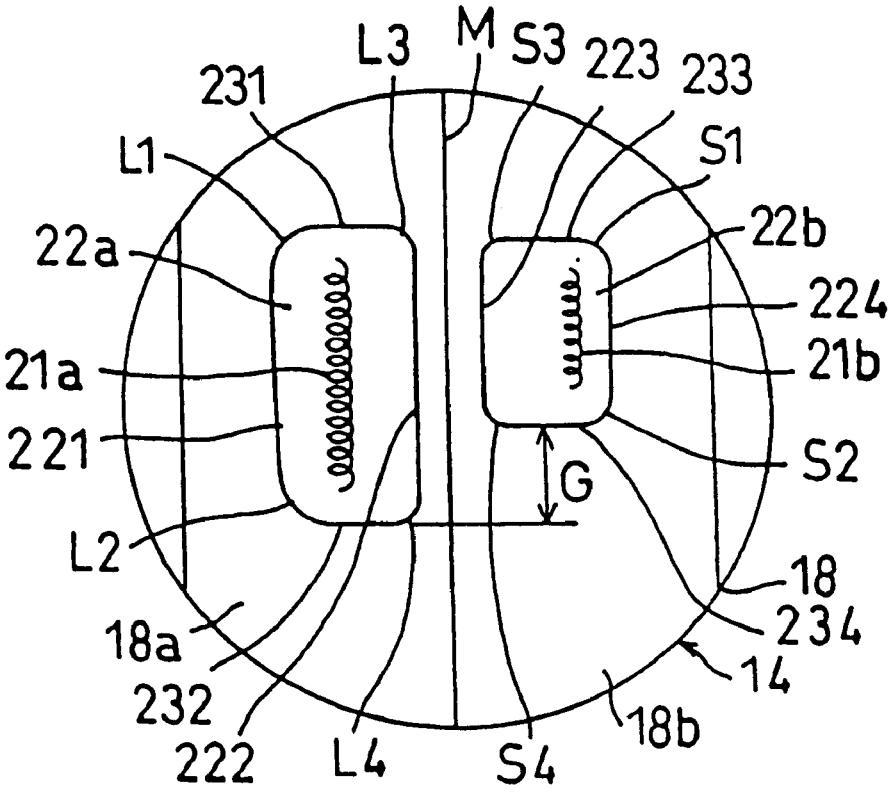
FIG. 10 is a plan view showing another embodiment of the present invention to explain the structure of the cathode portion.

Next, referring to FIG. 10, another embodiment of the present invention will be explained. In FIG. 10, portions corresponding to those in FIG. 3 through FIG. 7 and FIG. 9 are denoted by the same marks as in these figures, and repeated explanations will be partially omitted.

In this embodiment, end walls 231, 233 of focusing recess 22*a* for large focal spot and focusing recess 22*b* for small focal spot respectively at the upper side of the figure, are laid on substantially the same position in reference to the direction of the extension of bottom portion M. Thus large deviation G of position in the direction of the extension of bottom portion M occurs at end walls 232, 234 at the lower side of the figure. In this case, the curvature radius of corner L2 of focusing recess 22*a* for large focal spot, which is at the side of large deviation G and outside, is set to be the greatest of all corners. Then, curvature radii of corners L1, S1, S2 decrease in the order above, and are all greater than the curvature radii of the remaining corners i.e. the curvature radii of corners L3, L4, S3, S4.

Besides, with reference to both focusing recess 22*a* and focusing recess 22*b*, the two corners remote from bottom portion M are set to be in the range from 1 to 3 times of the space between the end wall and the end of the filament in the same way as FIG. 9. However only one of the above two corners may be set to be as mentioned above. Furthermore, only one of focusing recesses 22*a*, 22*b* may be set to be as mentioned above.

Further, with reference to both focusing recess 22*a* and focusing recess 22*b*, the two corners adjacent to bottom portion M are set to be in the range from 0.2 to less than 1 time of the space between the end wall and the end of the filament in the same way as FIG. 9. However only one of the above two corners may be set to be as mentioned above. Furthermore, only one of four corners of focusing recesses 22*a*, 22*b* adjacent to bottom portion M may be set to be as mentioned above.

Figure 11A:
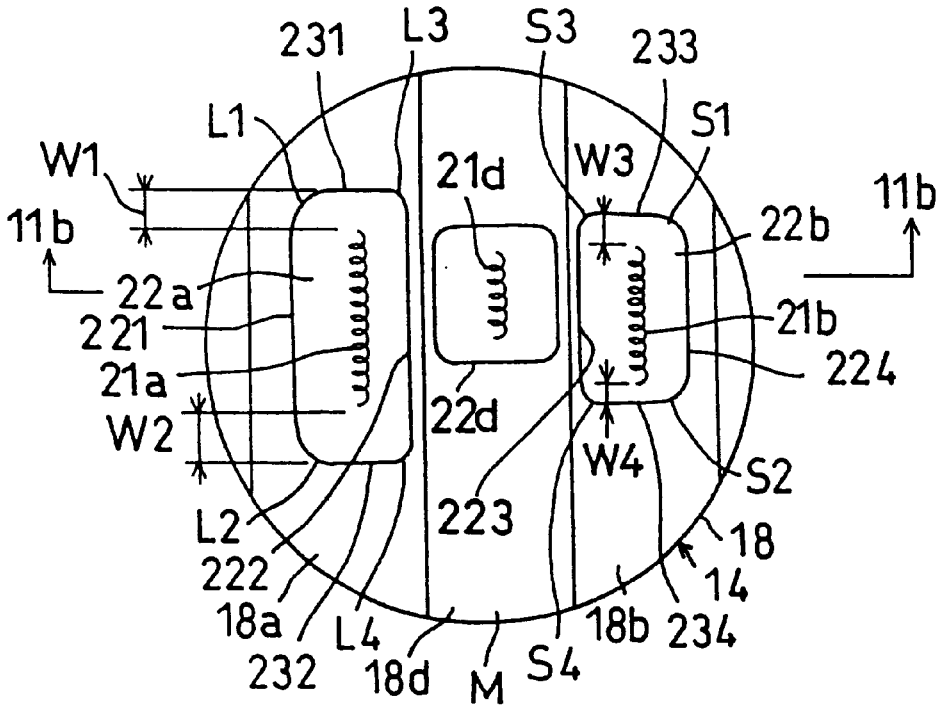
FIG. 11*a* is a schematic plan view showing the structure of cathode portion.
Figure 11B:
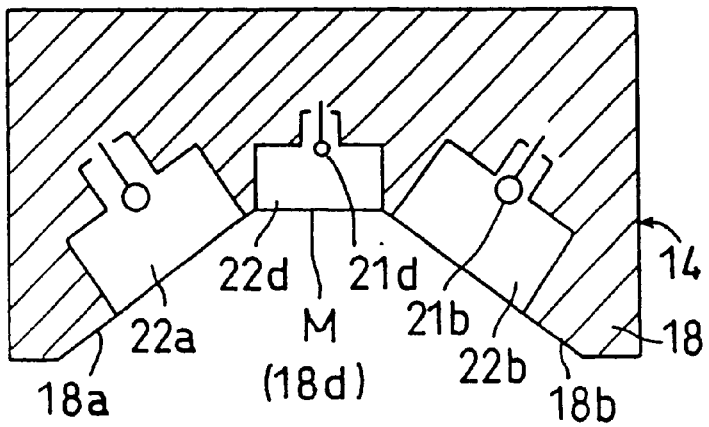
FIG. 11*b* is a cross section of the cathode portion along the line 11*b*–11*b;*

Next, referring to FIG. 11*a* and FIG. 11*b* which is a cross section of FIG. 11*a*, another embodiment of the present invention will be explained. In FIG. 11, portions corresponding to those in FIG. 3 through FIG. 7, FIG. 9 and FIG. 10 are denoted by the same marks as in these figures, and repeated explanations will be partially omitted. In this embodiment, bottom portion M is formed as plane surface 18*d* with a predetermined width at the recess in the center of focusing recess 18. At both sides thereof, slopes 18*a*, 18*b* are prepared. In this case, surfaces 18*a*, 18*b*, 18*d* where three focusing recesses for large focal spot, medium focal spot and small focal spot are formed respectively, are provided and those surfaces intersect each other at a predetermined angle with intervention of linear boundary portions. Then, focusing recess 22*d* and filament 21*d* for small focal spot are provided at plane surface 18*d* of bottom portion M. Focusing recess 22*a* and filament 21*a* for large focal spot are provided at slope 18*a*, and focusing recess 22*b* and filament 21*b* for medium focal spot are provided at slope 18*b*.

In this case, the structures of focusing recesses 22*a*, 22*b* provided at slopes 18*a*, 18*b* respectively, are for instance the same as those of focusing recesses 22*a*, 22*b* in FIG. 10. By the embodiments shown in FIG. 9 to FIG. 11, the cases where corners are formed as curved surfaces are illustrated. However, the corners can be prepared with flat wall surfaces instead of curved surfaces. In this case, the curvature radii of the surfaces correspond to the widths of the flat wall surfaces.

Figure 12A:
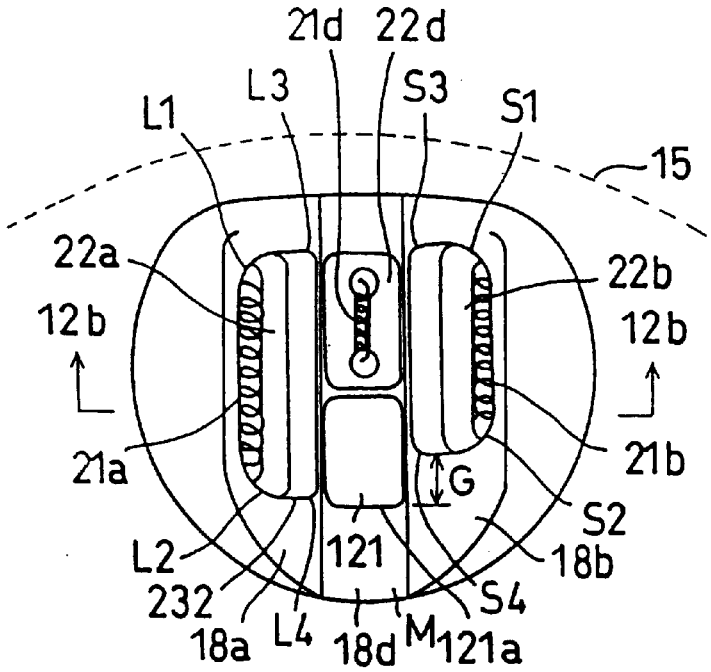
FIG. 12*a* is a schematic plan view showing the structure of cathode portion.
Figure 12B:
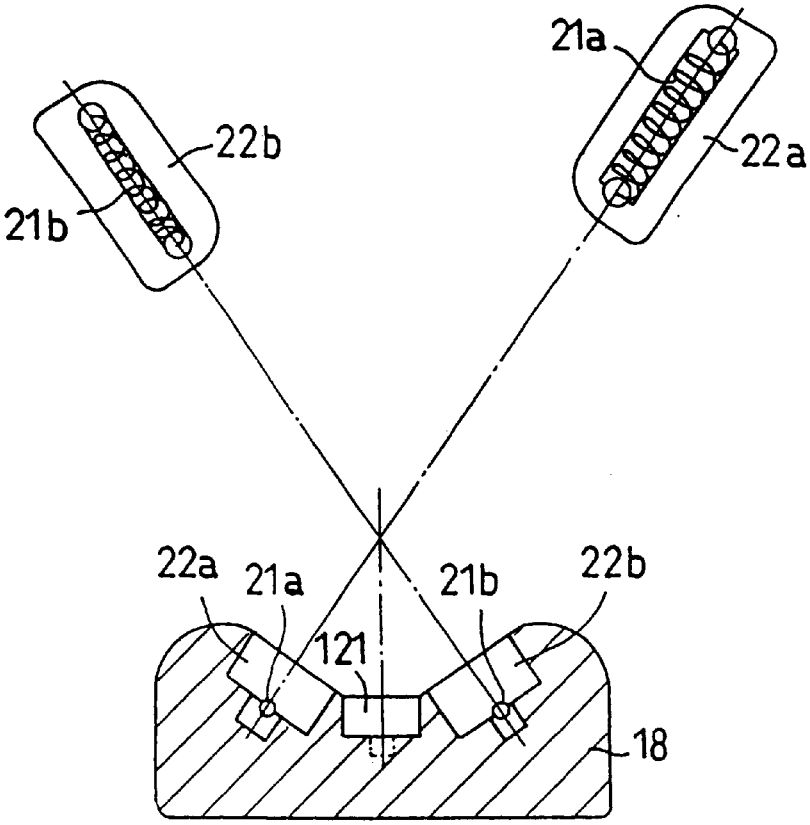
FIG. 12*b* is a cross section of the cathode portion and a schematic plan view of the focusing recesses seen from the front.

Next, referring to FIG. 12, another embodiment of the present invention will be explained. In FIG. 12, portions corresponding to those in FIG. 11 are denoted by the same marks as in the figure, and repeated explanations will be partially omitted. FIG. 12*a* shows a focusing electrode seen from a rotating anode (mark 15 in dot line), and FIG. 12*b* is a cross section of FIG. 12*a* cut at line 12*b*–12*b*. Furthermore, focusing recesses 22*a*, 22*b* and filaments 21*a*, 21*b* seen in the directions perpendicular to slopes 18*a*, 18*b* respectively are shown in the upper portion of the figure.

In this embodiment, the structure has three (large, medium, small) X-ray focal spots like FIG. 11. Bottom portion M in the center of focusing electrode 18 is formed as plane surface 18*d* with a predetermined width. At both sides thereof, slopes 18*a*, 18*b* are prepared. Then, focusing recess 22*d* and filament 21*d* for small focal spot are provided at plane surface 18*d*. Focusing recesses 22*a*, 22*b* and filaments 21*a*, 21*b* for large or medium focal spots are provided at slopes 18*a*, 18*b* respectively. Focusing recess 22*a* and filament 21*a* for large focal spot can be arranged at plane surface 18*d*.

The length of focusing recess 22*d* for small focal spot provided at central flat surface 18*d* is the shortest of all recesses. Outside the shortest focusing recess 22*d*, auxiliary recess 121 hollowed inside whose opening end is substantially rectangular configuration is provided. In this case, end wall 121*a* of auxiliary recess 121 remote from focusing recess 22*d* and end wall 232 of focusing recess 22*a* for large focal spot are laid on substantially the same position in reference to the direction of the extension of bottom portion M. Depths of focusing recess 22*d* and auxiliary recess 121 are equal to 2.8 mm, for example. Although it is preferable that these recesses are substantially the same in depth, it is sufficient that the depth of auxiliary recess 121 is 0.3 time of that of focusing recess 22*d* where a filament is accommodated. Moreover, the upper limit thereof is practically about 2 times.

The upper ends of focusing recesses 22*a*, 22*b* in the figure, are on substantially the same line, and deviation G occurs at the lower side of the figure. Thus focusing recesses 22*a*, 22*b* and filaments 21*a*, 21*b* provided in two slopes 18*a*, 18*b* have the same structures as, for example, focusing recesses 22*a*, 22*b* and filaments 21*a*, 21*b* in FIG. 10 respectively.

In this embodiment, the structures of the corners can be prepared not only by curved surfaces but also by flat wall surfaces. When flat wall surfaces are adopted, the radii of curved surfaces correspond to the widths of flat wall surfaces.

According to this structure, the electric field in the vicinity of focusing recesses 22*a*, 22*b*, 22*d* in the direction of the longer side thereof comes to be uniform, and results in realization of an X-ray tube having X-ray focal spots with less distortion. In compliance with conditions of the construction of focusing electrodes, focusing recesses etc., the length and arrangement etc. of auxiliary recess 121 can be suitably adjusted.

Figure 13:
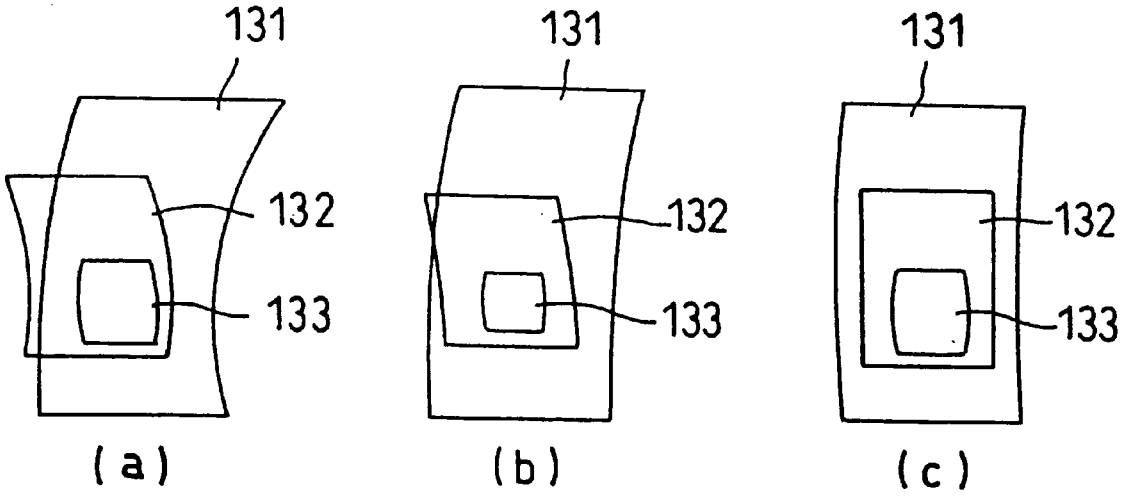
FIG. 13 is a plan view showing examples of the configuration of focal spot, where

Here, the configuration of focal spot when bottom portion M in the center of focusing electrode 18 is plane surface with a predetermined width, and slopes 18*a*, 18*b* are formed at both side thereof will be explained referring to FIG. 13. In this example, focusing recess 22*d* and filament 21*d* for small focal spot are provided at plane surface 18*d* in the center. Focusing recess 22*a* and filament 21*a* for large focal spot and focusing recess 22*b* and filament 21*b* for medium focal spot having medium size are provided at slopes 18*a*, 18*b* in both sides thereof respectively.

Marks 131, 132 and 133 denote large focal spot, medium focal spot, and small focal spot respectively. (a) of the figure is conventional technology where four corners of focusing recesses for both large and medium focal spots are formed with the same curvature and an auxiliary recess is not provided. (b) of the figure is the case where the curvatures of four corners are not the same, such as the curvature radius of corner L2 is the greatest of all like the embodiment in FIG. 11. (c) of the figure is the case where the curvature radii of four corners are set to be as aforementioned embodiment, and an auxiliary recess is provided.

In accordance with the embodiment of this invention, distortion of every focal spot is reduced and effect of providing the auxiliary recess is clearly recognized as shown in the figure.

Figure 14:
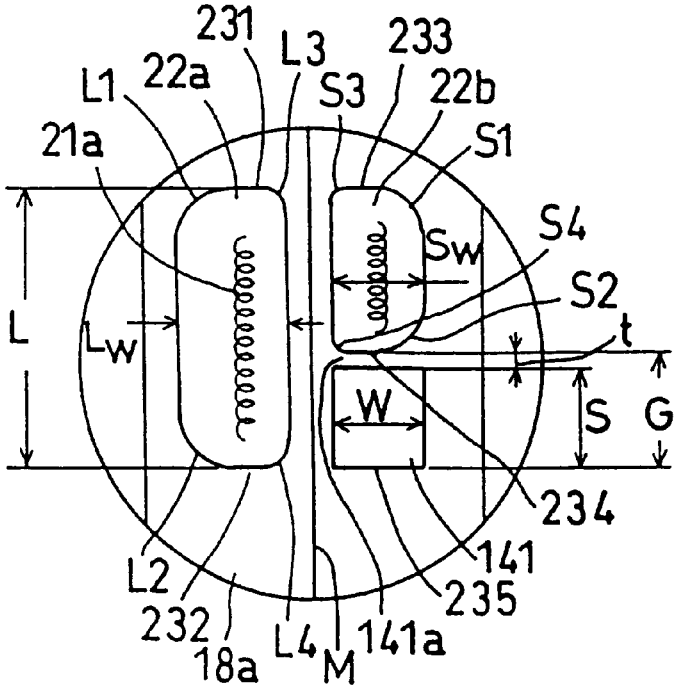
FIG. 14 is a plan view showing another embodiment of the present invention to explain the structure of the cathode portion.
Figure 15A:
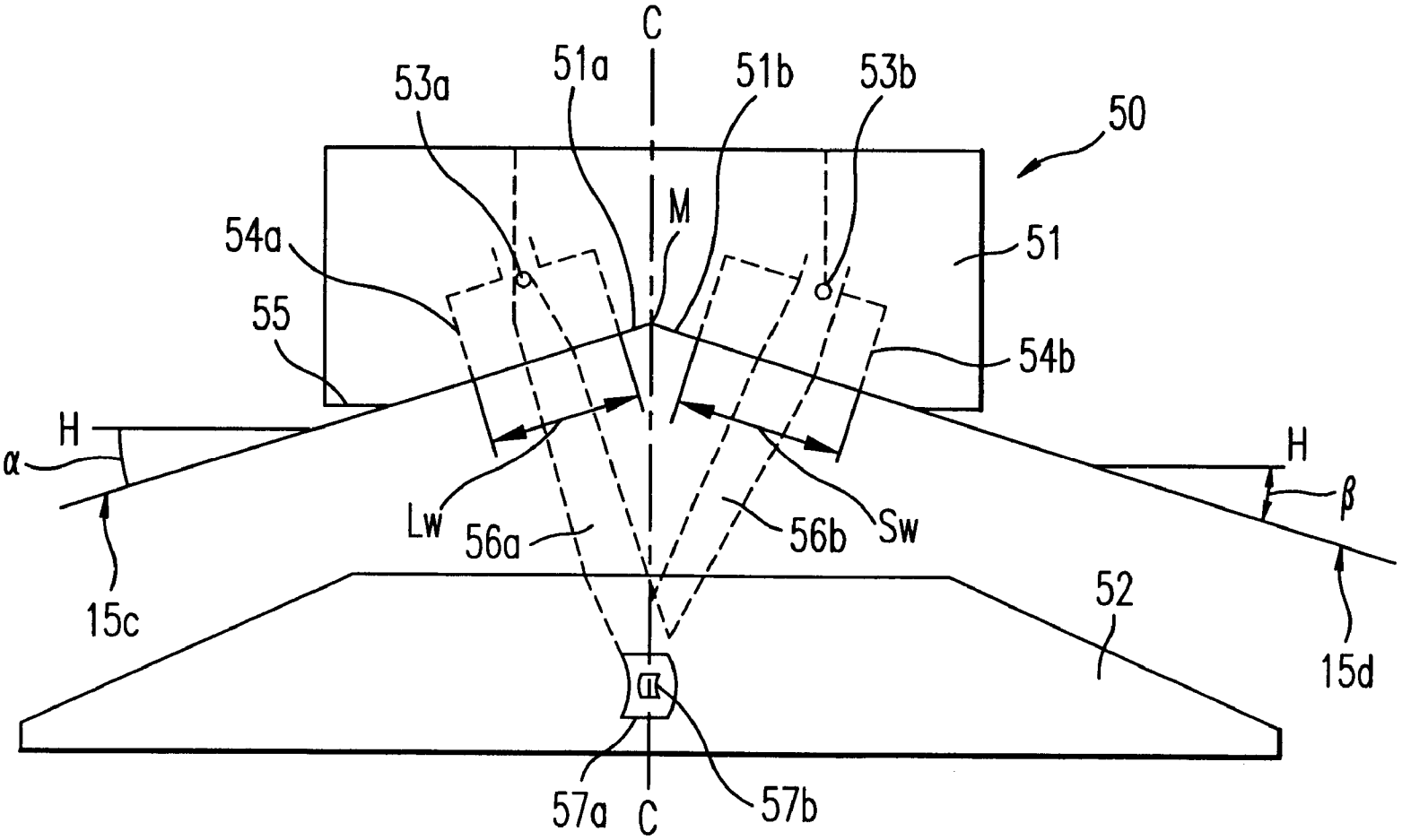
FIG. 15a PRIOR ART
FIG. 15*a* is a schematic view illustrating structures of cathode and anode portions.
Figure 15B:
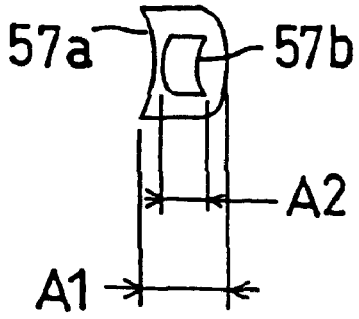
Fig. 15 b PRIOR ART
FIG. 15*b* is a plan view illustrating configurations of focal spots.
Figure 15C:
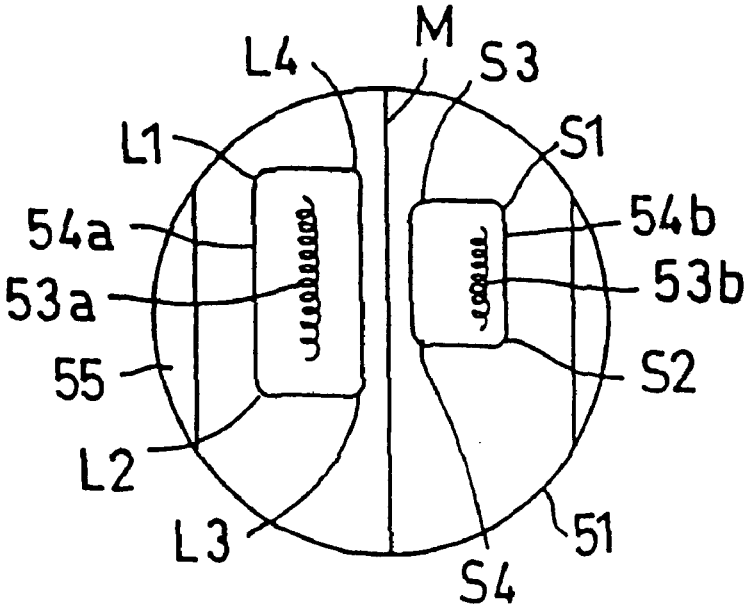
Fig. 15 c PRIOR ART
FIG. 15*c* is a schematic plan view illustrating structure of cathode portion.

Next, referring to FIG. 14, another embodiment of the present invention will be explained. This embodiment is an example in which an auxiliary recess is additionally provided adjacent to the focusing recess for small focal spot shown in FIG. 5. In FIG. 14, portions corresponding to those in FIG. 5 are denoted by the same marks as in the figure, and repeated explanations will be partially omitted.

With reference to the length of bottom portion M in the direction of the extension thereof, focusing recess 22*a* constituting filament 21*a* for large focal spot is longer than focusing recess 22*b* constituting filament 21*b* for small focal spot. End walls 231, 233 of focusing recesses 22*a*, 22*b* in the upper side of the figure, are on substantially the same line, and large deviation G occurs at the end walls 232, 234 in the lower side of the figure. Thus auxiliary recess 141 hollowed inside, whose opening is substantially rectangular is provided with intervention of thin separating wall 141*a*.

Accordingly, both ends 233, 235 of the recess row including focusing recess 22*b* for small focal spot and auxiliary recess 141, formed in one of the slopes, and both ends 231, 232 of focusing recess 22*a* for large focal spot formed in the other of the slopes are arranged to be on substantially the same position respectively in reference to the direction of the extension of bottom portion M.

For this purpose, width W of auxiliary recess 141 is selected to be substantially equal to width Sw of focusing recess 22*b* for small focal spot. Concerning the length along the direction of the extension of bottom portion M, the sum of the length of focusing recess 22*b* for small focal spot and the length S of auxiliary recess 141 is arranged to be substantially equal to length L of focusing recess 22*a* for large focal spot.

Separating wall 141*a* between focusing recess 22*b* and auxiliary recess 141 is 1 mm, preferably 0.5 mm or less in thickness t, and as far as mechanical strength not to deform can be assured, it is preferable for the thickness to be as thin as possible. Therefore, thickness t is practically negligible to the sum of the length of focusing recess 22*b* and the length of auxiliary recess 141.

According to this embodiment, distortions of large focal spot and small focal spot are reduced and the effective size of focal spot gets small. It is thought that this is due to the fact that the electric field adjacent to focusing recesses 22*a*, 22*b* particularly in the direction of the longer side of rectangular recesses becomes uniform by providing auxiliary recess 141 outside short focusing recess 22*b* for small focal spot.

In the embodiment mentioned above, width W of auxiliary recess 141 is substantially equal to width Sw of focusing recess 22*b* for small focal spot. However, width W can be narrower than width Sw of focusing recess 22*b* for small focal spot, under conditions of the structure of focusing electrode 18 and arrangement of focusing recesses 22*a*, 22*b* etc. But width W is required to be a half or more of width Sw of focusing recess 22*b*.

Further, the sum of the length of focusing recess 22*b* for small focal spot and length S of auxiliary recess 141 are substantially equal to length L of focusing recess 22*a* for large focal spot. However, the sum of the length of focusing recess 22*b* for small focal spot and length S of auxiliary recess 141 can be longer or shorter than length L of focusing recess 22*a* for large focal spot, under conditions of the structure of focusing electrodes and arrangement of focusing recesses etc.

By the above-mentioned embodiment, the electric field in the vicinity of all focusing recesses comes to be uniform over the extent where cathode filaments are accommodated in the direction of the longer side of focusing recesses, and results in realization of an X-ray tube having X-ray focal spots with less distortion.

In the case of the embodiment mentioned above, the curvature radii of corners remote from the bottom portion are set to be greater, or the widths of flat portions of plane wall surfaces are set to be wider. However, curvature radii of corners and widths of flat portions of plane wall surfaces can be suitably selected in compliance with conditions of the configuration of focusing electrodes and arrangement of focusing recesses.

Furthermore, in one focusing recess, the structure where corners of curved surface combine with flat wall surfaces can be adopted.

As the structure of focusing recess, very small recess or cut-out portions to mount a filament adjacent to the opening of the recess can be prepared. This invention can apply to a stationary anode X-ray tube. As a cathode for emitting electrons, a coiled direct heating type filament is preferable because of quickness of anode current control. However the filament is not necessarily inevitable, direct or indirect heating type cathode which is not coiled but planar for example can be used.

In the embodiments mentioned heretofore, the examples in which plane surfaces where focusing recesses are provided intersect each other with intervention of linear boundary portions are explained. However boundary portions are not necessarily linear but plane or curved surfaces having some area may be accepted.

According to this invention, an X-ray tube which has a relatively simple structure and no excessive parts with good characteristics where a distortion in configuration of a focal spot hardly occurs, can be realized.

What is claimed is:

1. An X-ray tube comprising:

an anode having a target surface radiating X-rays from a position of an X-ray focal spot by impingement of an electron beam, a focusing electrode having a bottom portion positioned facing said target surface of the anode and most remote from said X-ray focal spot, at least one inclined wall surface obliquely ascending from said bottom portion in the direction of said anode, and a substantially rectangular focusing recess formed at said inclined wall surface, and a cathode positioned in said focusing recess of the focusing electrode for emitting an electron beam, characterized in that said focusing recess has first and second corners which are rounded from at least one end wall facing the end of said cathode to two side walls along the direction of the longer side of said cathode, and in that the first corner located remote from said bottom portion is gentler than the second corner located adjacent to said bottom portion, with reference to curving degree.

2. An X-ray tube comprising:

an anode having a target surface radiating X-rays from a position of an X-ray focal spot by impingement of an electron beam, a focusing electrode having a bottom portion positioned facing said target surface of the anode and most remote from said X-ray focal spot, at least one inclined wall surface obliquely ascending from said bottom portion in the direction of said anode, and a substantially rectangular focusing recess formed at said inclined wall surface, and a cathode positioned in said focusing recess of the focusing electrode for emitting an electron beam, characterized in that said focusing recess has corners at both ends of at least one end wall facing the end of said cathode, which are formed as curved surfaces with predetermined curvature radii, and in that the first corner of said corners located remote from said bottom portion is greater than the second corner of said corners located adjacent to said bottom portion, with reference to curvature radius.

3. An X-ray tube comprising:

an anode having a target surface radiating X-rays from a position of an X-ray focal spot by impingement of an electron beam, a focusing electrode having a bottom portion positioned facing said target surface of the anode and most remote from said X-ray focal spot, at least first and second inclined wall surfaces obliquely ascending from said bottom portion in the direction of said anode, a substantially rectangular first focusing recess formed at said first inclined wall surface, and a substantially rectangular second focusing recess formed at said second inclined wall surface, whose two end walls located at the end of said bottom portion in the direction of the extension thereof are out of alignment by a substantially equal distance inside the two end walls of said first focusing recess in the direction of the extension of said bottom portion, and cathodes positioned in said first and second focusing recesses of the focusing electrode for emitting electron beams, characterized in that at least one of said first and second focusing recesses has corners at both ends of at least one end wall facing the end of said cathodes, which are formed as curved surfaces with a predetermined curvature radius, and in that the first corner located remote from said bottom portion is greater than the second corner located adjacent to said bottom portion, with reference to curvature radius.

4. An X-ray tube comprising:

an anode having a target surface radiating X-rays from a position of an X-ray focal spot by impingement of an electron beam, a focusing electrode having a bottom portion positioned facing said target surface of the anode and most remote from said X-ray focal spot, at least first and second inclined wall surfaces obliquely ascending from said bottom portion in the direction of said anode, a substantially rectangular first focusing recess formed at said first inclined wall surface, and a substantially rectangular second focusing recess formed at said second inclined wall surface, one of the two end walls of which located at the end of said bottom portion in the direction of the extension thereof is largely out of alignment inside the end wall of said first focusing recess in the direction of the extension of said bottom portion, and cathodes positioned in said first and second focusing recesses of the focusing electrode for emitting electron beams, characterized in that the corners of the end wall of said first focusing recess, which has a greater discrepancy to the end wall of said second focusing recess are formed as a curved surface with a predetermined curvature radius, and in that the first corner located remote from said second focusing recess is greater than the second corner located adjacent to said second focusing recess, with reference to curvature radius.

5. An X-ray tube comprising:

an anode having a target surface radiating X-rays from a position of an X-ray focal spot by impingement of an electron beam, a focusing electrode having a bottom portion positioned facing said target surface of the anode and most remote from said X-ray focal spot, at least first and second inclined wall surfaces obliquely ascending from said bottom portion in the direction of said anode, a substantially rectangular first focusing recess formed at said first inclined wall surface, and a substantially rectangular second focusing recess formed at said second inclined wall surface, one of the two end walls of which located at the end of said bottom portion in the direction of the extension thereof is located at substantially the same position as one of the two end walls of said first focusing recess, the other of said two end walls of said second focusing recess being out of alignment inside the other of the two end walls of said first focusing recess in the direction of the extension of said bottom portion, and cathodes positioned in said first and second focusing recesses of the focusing electrode for emitting electron beams, characterized in that the corners at both end of said other end wall of said first focusing recess are formed as a curved surface with a predetermined curvature radius, and in that the first corner located remote from said second focusing recess is greater than the second corner located adjacent to said second focusing recess, with reference to curvature radius.

6. The X-ray tube, as stated in claim 2, wherein the curvature radius of the first corner is one third or more of the width of the central part of the focusing recess having said first corner, in the direction perpendicular to the extension of the bottom portion.

7. The X-ray tube, as stated in claim 2, wherein the curvature radius of the first corner is one to three times of the space between the end wall adjacent to said first corner of the focusing recess having said first corner and the end of the cathode facing said end wall.

8. The X-ray tube, as stated in claim 2, wherein the curvature radius of the second corner is 0.2 to 1 times of the space between the end wall adjacent to said second corner of the focusing recess having said first corner and the end of the cathode facing said end wall.

9. An X-ray tube comprising: an anode having a target surface radiating X-rays from a position of an X-ray focal spot by impingement of an electron beam, a focusing electrode having a bottom portion positioned facing said target surface of the anode and most remote from said X-ray focal spot, at least first and second inclined wall surfaces obliquely ascending from said bottom portion in the direction of said anode, a substantially rectangular first focusing recess formed at said first inclined wall surface, and a substantially rectangular second focusing recess formed at said second inclined wall surface, one of the two end walls of which located at the end of said bottom portion in the direction of the extension thereof is largely out of alignment inside the two end walls of said first focusing recess in the direction of the extension of said bottom portion, and cathodes positioned in said first and second focusing recesses of the focusing electrode for emitting electron beams, characterized in that the corners of both end walls of said first focusing recess are formed as a curved surface with a predetermined curvature radius, in that the first corner located remote from said second focusing recess is greater than the second corner located adjacent to said second focusing recess with reference to curvature radius, and in that an auxiliary recess is provided at the side where the discrepancy of the end walls to the end wall of said first focusing recess is large, adjacent to said second focusing recess.

10. An X-ray tube comprising:

an anode having a target surface radiating X-rays from a position of an X-ray focal spot by impingement of an electron beam, a focusing electrode having a bottom portion positioned facing said target surface of the anode and most remote from said X-ray focal spot, at least first and second inclined wall surfaces obliquely ascending from said bottom portion in the direction of said anode, a substantially rectangular first focusing recess formed at said first inclined wall surface, and a substantially rectangular second focusing recess formed at said second inclined wall surf ace, one of the two end walls of which located at the end of said bottom portion in the direction of the extension thereof is located at substantially the same position as one of the two end walls of said first focusing recess, the other of said two end walls being out of alignment inside the other of the two end walls of said first focusing recess in the direction of the extension of said bottom portion, and cathodes positioned in said first and second focusing recesses of the focusing electrode for emitting electron beams, characterized in that the corners at both end of said other end wall of said first focusing recess are formed as a curved surface with a predetermined curvature radius, in that the first corner located remote from said second focusing recess is greater than the second corner located adjacent to said second focusing recess with reference to curvature radius, and in that an auxiliary recess is provided at the side where the discrepancy of the end walls to the end wall of said first focusing recess is large, adjacent to said second focusing recess.

11. The X-ray tube, as stated in claim 9, wherein the depth of the auxiliary recess is 0.3 times or more of the depth of the second focusing recess.

12. The X-ray tube, as stated in claim 9 or, wherein the length of the first focusing recess in the direction of the extension of the bottom portion is substantially equal to the sum of the length of the second focusing recess and the length of the auxiliary recess in the direction of the extension of the bottom portion, and the position of one of the ends of both said second focusing recess and said auxiliary recess are substantially the same as the position of the end walls of said first focusing recess, with reference to the direction of the extension of said bottom portion.

13. The X-ray tube, as stated in claim 3, wherein with reference to four corners of at least one of the first focusing recess and the second focusing recess, two corners positioned remote from the other focusing recess are greater than two corners positioned adjacent to the other focusing recess, with respect to curvature radius.

14. The X-ray tube, as stated in claim 13, wherein the curvature radii of the two corners positioned remote from the other focusing recess are in the range between one to three times of the space between the end wall of the focusing recess having said two corners and the end of the cathode facing thereto.

15. The X-ray tube, as stated in claim 13, wherein the curvature radii of the two corners positioned adjacent to the other focusing recess are 0.2 times or more but less than 1 times of the space between the end wall of the focusing recess having said two corners and the end of the cathode facing thereto.

16. The X-ray tube, as stated in claim 5, wherein the curvature radius of the first corner is greater than the curvature radius of the other corners in the first and second focusing recesses.

17. The X-ray tube, as stated in claim 3, wherein at least one of the first focusing recess and the second focusing recess has a side wall substantially parallel to the bottom portion remote from the other focusing recess, and the center portion of said side wall swells outside.

18. An X-ray tube comprising:

an anode having a target surface radiating X-rays from a position of an X-ray focal, spot by impingement of an electron beam, a focusing electrode having a bottom portion positioned facing said target surface of the anode and most remote from said X-ray focal spot, first and second inclined wall surfaces obliquely ascending from said bottom portion in the direction of said anode, a substantially rectangular first focusing recess formed at said first inclined wall surface, a bottom portion focusing recess formed at said bottom portion and the length thereof being shorter than said first focusing recess in reference to the direction of the extension of said bottom portion, and a second focusing recess formed at said second inclined wall surface, and the length thereof being longer than said bottom portion focusing recess and shorter than said first focusing recess in reference to the direction of the extension of said bottom portion, and cathodes positioned in said focusing recesses of the focusing electrode for emitting electron beams, characterized in that with reference to at least one of said first focusing recess and said second focusing recess, at least one corner at the both ends of the end wall is formed as a curved surface, and in that the curvature radius of the first corner remote from the other focusing recess is greater than the curvature radius of the second corner adjacent to the other focusing recess.

19. The X-ray tube as stated in claim 18, wherein an auxiliary recess is provided outside the end wall in the direction of the extension of the bottom portion wall surface, where greater discrepancy to the end walls of the first focusing recess occurs, and adjacent to the second focusing recess.

20. The X-ray tube as stated in claim 19, wherein the depth of the auxiliary recess is 0.3 times or more of the depth of the second focusing recess.

21. The X-ray tube as stated in claim 19, wherein the length of the first focusing recess is substantially equal to the sum of the length of the second focusing recess and the length of the auxiliary recess, in the direction of the extension of the bottom portion wall surface, and one of the end walls of both said second focusing recess and said auxiliary recess is substantially on the same position as one of the end wall of said first focusing recess in reference to the direction of the extension of the bottom portion wall surface.

22. An X-ray tube comprising: an anode having a target surface radiating X-rays from a position of an X-ray focal spot by impingement of an electron beam, a focusing electrode having a bottom portion positioned facing said target surface of the anode and most remote from said X-ray focal spot, at least one inclined wall surface obliquely ascending from said bottom portion in the direction of said anode, and a substantially rectangular focusing recess formed at said inclined wall surface, and a cathode positioned in said focusing recess of the focusing electrode for emitting an electron beam, characterized in that with reference to said focusing recess, at least one of the corners of both ends of the end wall facing the end of said cathode is formed as a plane surface with a predetermined width extending in the direction of the depth of the focusing recess, and in that the width of the plane surface of the first corner remote from said bottom portion is greater than that of the second corner adjacent to said bottom portion.

23. An X-ray tube comprising:

an anode having a target surface radiating X-rays from a position of an X-ray focal, spot by impingement of an electron beam, a focusing electrode having a bottom portion positioned facing said target surface of the anode and most remote from said X-ray focal spot, at least one inclined wall surface obliquely ascending from said bottom portion in the direction of said anode, and a substantially rectangular focusing recess formed at said inclined wall surface, and a cathode positioned in said focusing recess of the focusing electrode for emitting an electron beam, characterized in that with reference to said focusing recess, one of the two corners between which at least one end wall facing the end of said cathode is put, is formed as a curved surface with a predetermined curvature radius, in that the other of the two corners is formed as a plane surface with a predetermined width extending in the direction of the depth of the focusing recess, and in that the first corner remote from said bottom portion is greater than the second corner adjacent to said bottom portion, with reference to curvature radius or to width of plane surface.

24. An X-ray tube comprising:

an anode having a target surface radiating X-rays from a position of an X-ray focal spot by impingement of an electron beam, a focusing electrode having a bottom portion positioned facing said target surface of the anode and most remote from said X-ray focal spot, a first inclined wall surface and a second inclined wall surface interposing said bottom portion and obliquely ascending from said bottom portion in the direction of said anode, a substantially rectangular first focusing recess formed at said first inclined wall surface, a substantially rectangular second focusing recess formed at said second inclined wall surface, and a bottom portion focusing recess formed at said bottom portion, the length of the bottom portion recess being different from said first focusing recess and said focusing recess in reference to the direction of the extension of said bottom portion, and cathodes positioned respectively and in parallel with each other in said focusing recesses of the focusing electrode for emitting electron beams, characterized in that at least one of said first focusing recess and said second focusing recess of said focusing electrode has four corners with predetermined curvature radii respectively, and in that the curvature radius of the two corners remote from the other focusing recess is greater than the curvature radius of the other two corners adjacent to the other focusing recess.

* * * * *